United States Patent [19]

Lockwood et al.

[11] Patent Number: 4,999,122

[45] Date of Patent: Mar. 12, 1991

[54] NON-AQUEOUS LAMELLAR LIQUID CRYSTALLINE LUBRICANTS

[75] Inventors: Frances E. Lockwood, The Woodlands, Tex.; James G. Lazar, Mountainview, Calif.; Clarence M. Comer, Spring, Tex.; Selda Gunsel, Houston, Tex.; Stig E. Friberg, Potdam, N.Y.

[73] Assignee: Pennzoil Products Company, Houston, Tex.

[21] Appl. No.: 292,458

[22] Filed: Dec. 30, 1988

[51] Int. Cl.[5] ..... C10M 137/02; C10M 141/06

[52] U.S. Cl. ..... 252/32.5; 252/33.4; 252/47.7; 252/49.6; 252/51.5 R; 252/299.0

[58] Field of Search ..... 252/32.5, 33.4, 299.01, 252/47, 49.6, 51.5 R

[56] References Cited

U.S. PATENT DOCUMENTS

| | | | |
|---|---|---|---|
| 2,852,353 | 9/1958 | Craig et al. . | |
| 3,928,215 | 12/1975 | Dreher et al. . | |
| 3,933,661 | 1/1976 | Abrams et al. . | |
| 3,935,337 | 1/1976 | Taylor . | |
| 3,951,845 | 4/1976 | Cole, Jr. . | |
| 3,960,753 | 6/1976 | Larrabee . | |
| 3,972,589 | 8/1976 | Skelly et al. . | |
| 4,052,331 | 10/1977 | Dumoulin . | |
| 4,113,635 | 9/1978 | Sakurai et al. . | |
| 4,234,437 | 11/1980 | Friberg et al. . | |
| 4,289,546 | 9/1981 | Hacias . | |
| 4,293,193 | 10/1981 | Labes et al. . | |
| 4,388,453 | 6/1983 | Finkelmann et al. . | |
| 4,410,570 | 10/1983 | Kreuzer et al. . | |
| 4,637,885 | 1/1987 | Kuwamoto et al. | 252/32.5 |
| 4,749,777 | 6/1988 | Kohtoh et al. | 252/99.01 |

OTHER PUBLICATIONS

Friberg et al, *The Journal of Physical Chemistry*, 88, 1045–6 (1984).

Friberg et al, *The Journal of Pharmaceutical Sciences*, vol. 74, No. 7 (Jul. 1985).

Lockwood et al, *ASLE Transactions*, vol. 30, 4, 539–548 (1987).

Friberg et al, *Journal of Dispersion Science and Technology*, 8 (4), 407–422 (1987).

*Chemical Abstracts*, vol. 107, 1987, No. 13538j.

Friberg et al, "Solubilization in Lyotropic Liquid Crystals", *J. Dis. Sci. Techn.*, Dec. 30, 1987.

*Primary Examiner*—Jacqueline V. Howard

*Attorney, Agent, or Firm*—Lowe, Price, Leblanc, Becker & Shur

[57] ABSTRACT

Non-aqueous lamellar liquid crystalline lubricant compositions comprise an organic acid component or a salt thereof, an organic amine component and a non-aqueous solvent which maintains the liquid crystalline properties of a mixture of the organic acid or salt thereof and the organic amine. The organic acid component is selected from the group consisting of alkyl phosphonic acids, aryl phosphonic acids, alkyl sulfonic acids and aryl sulfonic acids. The weight ratios of the components are such that the compositions exhibit lamellar liquid crystalline properties, the weight ratio of organic acid to organic amine is in the range of about 1:1 to about 5:1 and the solvent comprises not greater than about 75 weight percent of the composition.

13 Claims, 3 Drawing Sheets

NON-AQUEOUS LAMELLAR LIQUID CRYSTALLINE LUBRICANTS

FIELD OF THE INVENTION

The present invention relates to non-aqueous lamellar liquid crystalline compositions which are useful as lubricants and as friction modifiers in lubricating oil compositions owing to their advantageous combination of physical properties. More particularly, the present invention relates to non-aqueous lamellar liquid crystalline compositions which comprise an organic acid component or a salt thereof, an organic amine component and a non-aqueous solvent.

BACKGROUND OF THE INVENTION

Lamellar liquid crystal compounds comprising triethanolammonium oleate have been prepared directly from triethanolamine and oleic acid as disclosed by Friberg et al, *The Journal of Physical Chemistry*, 1984, 88 1045–6. Friberg et al disclose that the basis for the lyotropic mesomorphism is the fact that part of the triethanolammonium oleate has changed to triethanolamine and oleic acid which serve as solvents in the liquid crystalline structure. The influence of solvents on the non-aqueous lyotropic liquid crystalline phase formed by triethanolammonium oleate is described by Friberg et al, *The Journal of Pharmaceutical Sciences*, Vol. 74, No. 7, July 1985. Friberg et al disclose that the region of stability of the lamellar liquid crystalline phase on addition of soluble glycols or oils was found to depend on the molar ratio of triethanolamine to oleic acid. A series of ethylene glycol oligomers which were solubilized in the polar part of the structure showed maximum solubilization at an acid to amine mole ratio of 1.6 while the organic oils on the other hand which are solubilized into the hydrophobic part of the structure exhibited maximum solubilization at an acid to amine mole ratio of 0.8.

Additional liquid crystal compositions comprising oleic acid and triethanolamine, oleic acid, triethanolamine and glycerol, and alkyl sulfonic acid and triethanolamine are further described by Lockwood et al, *ASLE Transactions*, Vol. 30, 4, 539–548 (1987). Lockwood et al acknowledge that although lyotropic liquid crystals with water as the solvent have been known for a long time and studied extensively, the corresponding systems in which water is replaced with a non-aqueous solvent have been little known. Lockwood et al also disclose the use of lamellar liquid crystals as lubricants. Liquid crystalline structures in which water has been replaced with a polar organic solvent to achieve the mesomorphic state are also discussed by Friberg et al, *Journal of Dispersion Science and Technology*, 8 (4), 407–422 (1987), wherein lamellar liquid crystal compositions of sodium dodecyl sulfate, decanol and glycerol, among others, are disclosed. Friberg et al disclose that for many systems the region of stability of liquid crystal compositions is severely limited when a non-aqueous solvent is employed.

SUMMARY OF THE INVENTION

Accordingly, it is an object of the present invention to provide novel lamellar liquid crystalline compositions and, more particularly, to provide non-aqueous lamellar liquid crystalline compositions which are useful as lubricants or as friction-modifying additives in lubricating oil compositions. It is an additional object of the present invention to provide non-aqueous lamellar liquid crystalline compositions which maintain liquid crystallinity over a broad temperature range. It is a further object of the invention to provide lamellar liquid crystal compositions which exhibit low viscosity-pressure coefficients.

These and additional objects are provided by the non-aqueous lamellar liquid crystalline compositions of the present invention. The present compositions comprise an organic acid component or a salt thereof, an organic amine component which forms a liquid crystal with the acid or salt thereof, and a non-aqueous solvent which maintains the liquid crystalline properties of a mixture of the organic acid or salt thereof and the organic amine. The organic acid component preferably is a long chain acid selected from the group consisting of alkyl phosphonic acids, aryl phosphonic acids, alkyl sulfonic acids and aryl sulfonic acids. The weight ratios of the components are such that the compositions exhibit lamellar liquid crystalline properties, the weight ratio of the organic acid to organic amine is in the range of about 1:1 to about 5:1, and the solvent comprises not greater than about 75 weight percent of the composition. The components may be varied within these parameters in order to adjust the viscosity, transition temperature and/or solubility toward additives while maintaining the liquid crystalline phase.

These and additional objects and advantages will be more fully understood in view of the following detailed description.

DETAILED DESCRIPTION

Figure 1:
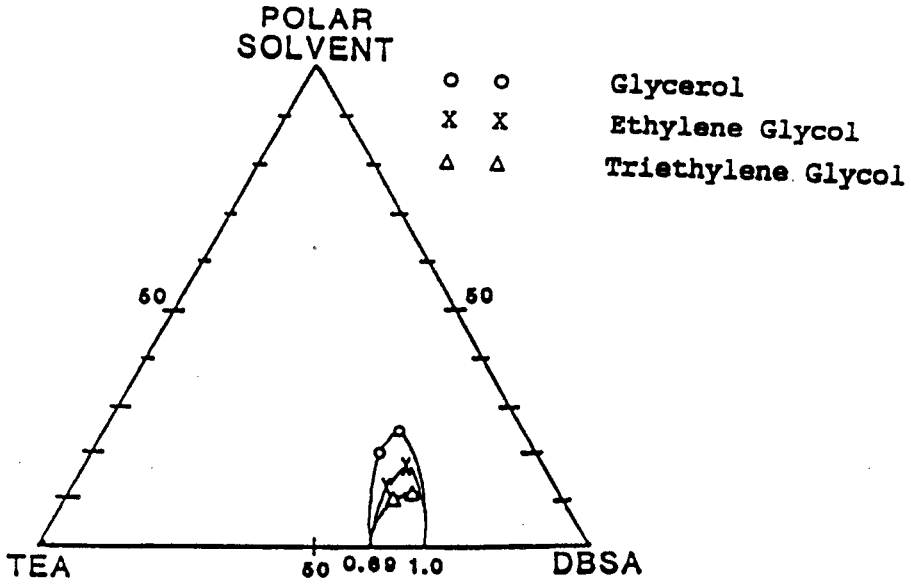
FIGS. 1 and 2 are graphical representations of the region of stability of the lamellar liquid crystalline phase of several compositions according to the present invention as described in the Example.

The non-aqueous lamellar liquid crystalline compositions according to the present invention comprise an organic acid component or a salt thereof, an organic amine component and a non-aqueous solvent. The organic acid and the amine create an amphiphilic salt having hydrophobic and hydrophilic parts. Only certain ratios of the acid or salt and the amine provide stable liquid crystalline compositions. The solvent is added in limited amounts without disrupting the liquid crystalline phase. The addition of the non-aqueous solvent may be used to control the temperature at which the liquid crystals undergo transition to the isotropic phase.

The organic acid component comprises a long chain acid and preferably is selected from the group consisting of alkyl phosphonic acids, aryl phosphonic acids, alkyl sulfonic acids, and aryl sulfonic acids. The organic acid component may be replaced by a salt of one of the recited acids. Preferably, the alkyl group which is included in the alkyl phosphonic acid or alkyl sulfonic acid comprises at least six carbon atoms, and, more preferably, comprises from 6 to about 20 carbon atoms.

The aryl acids and salts thereof may include one or more aromatic rings.

The amine component may be any mono-, di- or tri-amine which forms a liquid crystalline structure with the organic acid or salt thereof. Preferred amines include triethanolamine, diethanolamine and ethanolamine, ethyldiethanol amine and analogous amines, long chain amines such as tallow amine or any of its amine components such as n-dodecyl-1,3-diaminopropane, n-oleyl-1,3diaminopropane, n,n-dimethylamino-thioethers, and the like. A preferred amine component comprises triethanolamine.

The compositions of the present invention also include a non-aqueous solvent which maintains the liquid crystalline properties of a mixture of the organic acid component or salt thereof and the amine component. The solvent incorporates itself between layers of amphiphile formed from the acid or salt and the amine, or within the amphiphile without disrupting the liquid crystalline structure. Solvents which exhibit strong hydrogen bonding may be employed as well as less polar solvents such as, for example, pentaerythritol ester and the like. The acid and amine components form a rod-like, amphiphilic pair. Sufficient dispersion forces act between pairs to produce an ordered material. Solvents including long chains or multiple ring structures with polar end groups are therefore preferred. Preferred solvents also include, but are not limited to, the group consisting of glycols such as glycerol, ethylene glycol, triethylene glycol, polethylene glycol and the like, squalane, mineral oils, hydrocarbon esters such as pentaerythritol and isopropyl myristate, silicone fluids and the like.

As set forth above, only certain ratios of the acid or salt thereof, the amine and the non-aqueous solvent afford stable liquid crystalline compositions. Thus, it is important that the weight ratios of these three components are controlled such that the composition exhibits lamellar liquid crystalline properties. Additionally, the ratio of organic acid or salt thereof to amine should be in the range of about 1:1 to about 5:1, and the non-aqueous solvent should comprise not greater than about 75 weight percent of the acid or salt thereof, the amine and the solvent combined. Preferably, the weight ratio of the acid or salt thereof to the amine is in the range of about 1:1 to 3:1 and the non-aqueous solvent comprises not greater than 50 weight percent of the three components combined. More preferably, the non-aqueous solvent comprises not greater than about 25 weight percent of the three components combined. It is noted that dispersions of liquid crystal in the solvent may also be formed from the three components. Such dispersions may potentially be useful. For example, solutions of the acid and amine components in solvents have been found to be good friction modifiers when the ratio of acid to amine is within the liquid crystalline region of the two component phase diagram. However, for any given acid/amine pair and solvent combination, it is preferred to adjust the composition to provide the minimum interlayer spacing of the liquid crystal, thereby maintaining liquid crystallinity and achieving minimum friction properties. In practice, the ratio of components may deviate from this preferred embodiment in order to provide the composition with a desired viscosity or other physical property.

The non-aqueous lamellar liquid crystalline compositions are prepared by mixing the two most miscible components to achieve a homogeneous mixture. Generally the acid and amine should not be mixed first because it is difficult to dissolve the resulting salt in the solvent. It is preferred that the acid is first dissolved in a non-polar solvent or the amine is first dissolved in a polar solvent. Alternatively, all components may be combined in a volatile solvent which when stripped from the mixture leaves the lamellar liquid crystalline composition. This is a particularly effective method when other additives such as oxidation inhibitors, extreme pressure agents, corrosion inhibitors and the like are included in the compositions.

The liquid crystalline compositions of the invention are advantageous in that they maintain their liquid crystallinity over a broad temperature range. Additionally, their viscosities, transition temperatures and solubility toward additives may be adjusted by varying the acid-/amine ratio or solvent content while maintaining the liquid crystalline phase. The compositions exhibit improved normal stresses in shear flow, in some cases up to two orders of magnitude greater than conventional fluids. The liquid crystal compositions exhibit low viscosity-pressure coefficients and are shear thinning. Owing to these properties, the fluid film friction of the compositions is low, particularly as compared with conventional fluids under increasing shear and/or increasing pressure conditions. The compositions exhibit low to extraordinarily low friction under low sliding conditions and comparisons with commercial fluids and greases of comparable viscosity indicated that the liquid crystal compositions exhibited vastly reduced friction. In view of these properties, the liquid crystal compositions are useful as lubricants in many applications.

Additionally, the liquid crystal compositions are useful as friction-modifying additives in lubricating oil compositions. Such lubricating oil compositions may comprise mineral oil, synthetic oil or mixtures thereof. Preferably, the friction modifier comprising the non-aqueous lamellar liquid crystalline material of the present invention is included in such lubricating compositions in an amount of from about 0.1 to about 5 weight percent.

The following example demonstrates several non-aqueous lamellar liquid crystalline compositions according to the present invention:

EXAMPLE

Non-aqueous lamellar liquid crystalline compositions according to the present invention were prepared comprising dodecylbenzene sulfonic acid, triethanolamine and one of the following solvents:

| Solvents: | Grade | Source |
|---|---|---|
| Glycols | | |
| Glycerol | 99.6% | Fisher certified |
| Ethylene glycol | 99% | Fisher certified |
| Triethylene glycol | 99% | Aldrich |
| Organic Oils | | |
| Isopropyl myristate | Grade I | Sigma Chemical |
| Naphthenic oil | 30DSUS | Commercial sample |
| Squalane | 99% | Aldrich |

Figure 2:
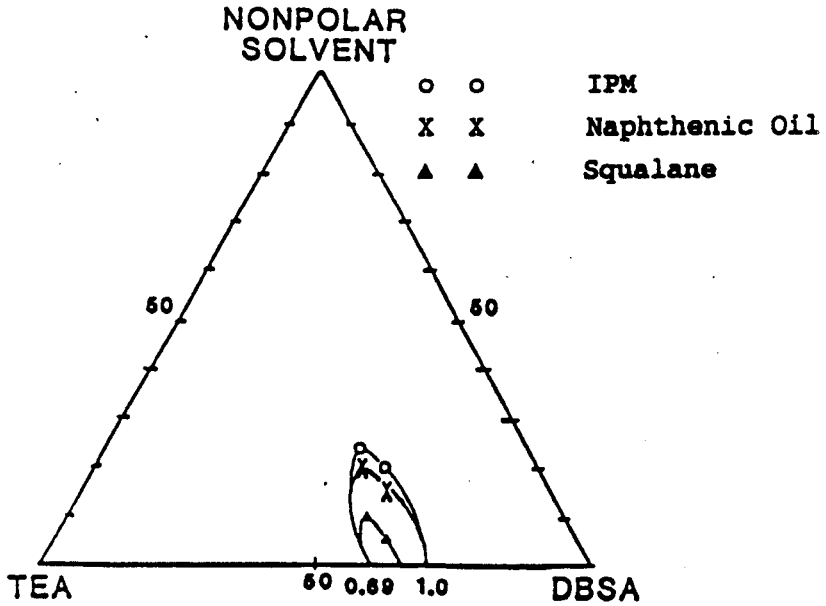

The compositions were prepared by weighing the components into glass vials and mixing with a Vortex vibromixer. The compositions were analyzed for liquid crystalline structure by microscopic observation in polarized light. The weight ratios of the acid, amine and solvent components included in the liquid crystal compositions prepared are set forth in FIGS. 1 and 2. FIG. 1 relates to the compositions prepared using a polar solvent comprising glycerol, ethylene glycol or triethylene glycol while FIG. 2 relates to the compositions prepared using a nonpolar solvent comprising isopropyl myristate (IPM), naphthenic oil or squalane. The results set forth in FIGS. 1 and 2 demonstrate that the region of stability of the lamellar liquid crystalline phase depends on the molar ratio of the acid and amine. Additionally, the more polar solubilizates showed higher acid/amine ratios for maximum solubilization, FIG. 1, as compared with the less polar solubilizates, FIG. 2. The maximum solubilization of polar solvents was in the order of glycerol, ethylene glycol and triethylene glycol while the order of maximum solubilization of the nonpolar solvents was isopropyl myristate, naphthenic oil and squalane.

Figure 3:
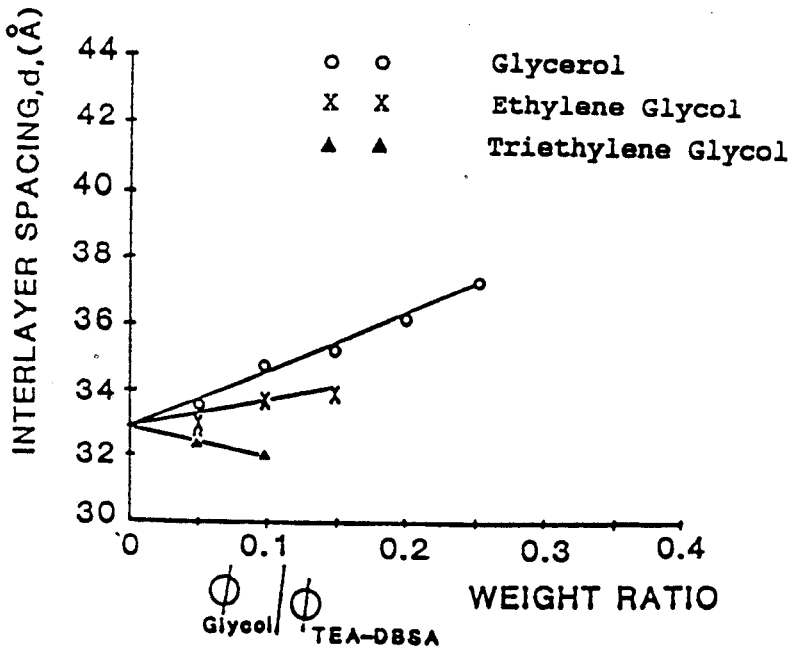
FIGS. 3 and 4 are graphical representations of interlayer spacings of lamellar liquid crystalline materials according to the present invention as set forth in the Example.
Figure 4:
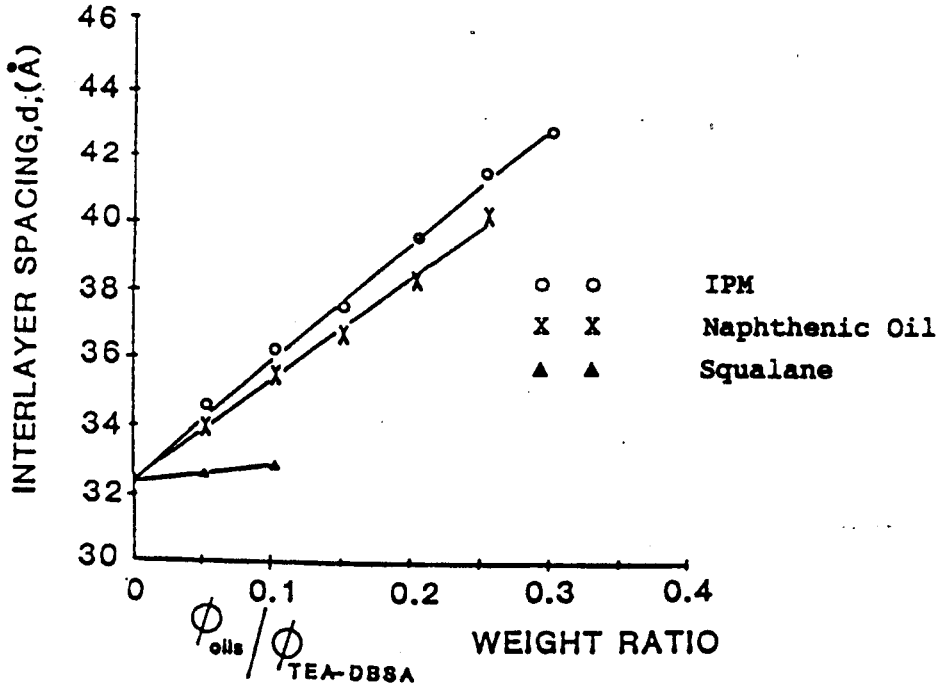
Figure 5:
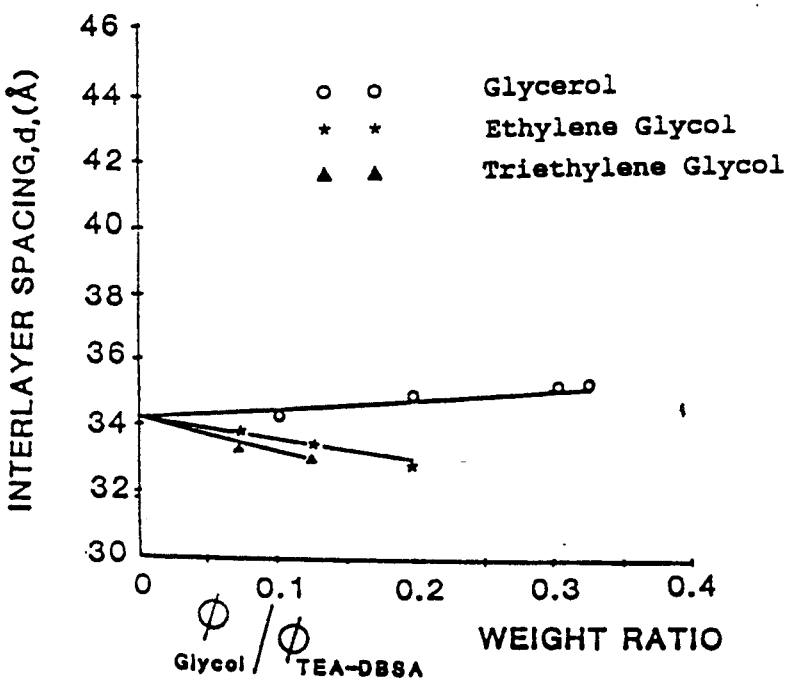
FIGS. 5 and 6 are graphical representations of interlayer spacings of further lamellar liquid crystalline materials according to the present invention as set forth in the Example.
Figure 6:
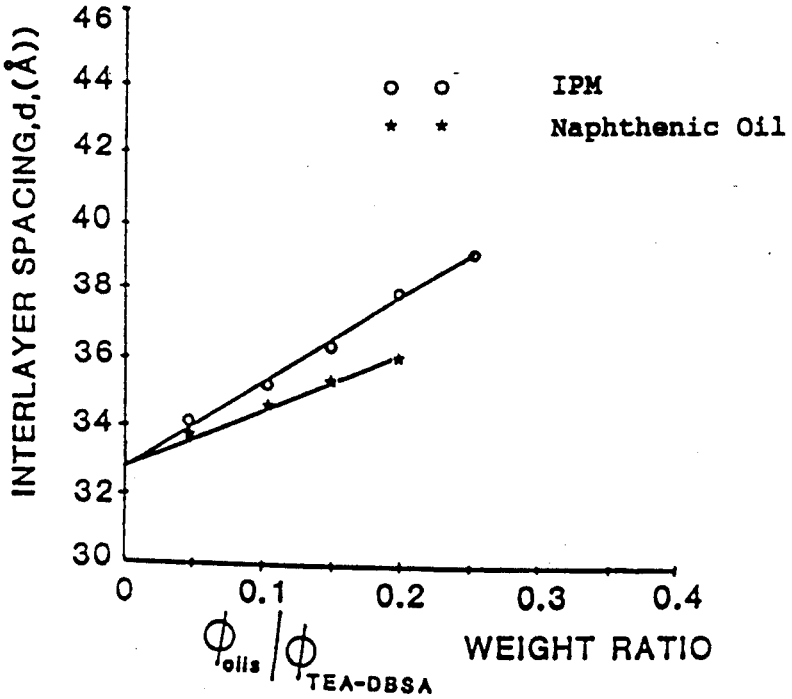

The interlayer spacing of the liquid crystalline compositions were determined from the small angle X-ray diffraction pattern as taught by Fontell, *Liquid Crystals and Plastic Crystals*, Gray et al, Eds., Vol. 2, Ellis Harwood: Chichester, 1974, page 80. The results are set forth in FIGS. 3–6. FIGS. 3 and 4 relate to the compositions wherein the mole ratio of amine to acid was approximately 0.69 while FIGS. 5 and 6 relate to compositions wherein the mole ratio of amine to acid was approximately 1.0. The change of interlayer spacing with solubilization varied so that the slope of the interlayer spacing was reduced in the order glycerol, ethylene glycol and triethylene glycol for the polar solvents at both ratios of amine to acid, and in the order isopropyl myristate, naphthenic oil and squalane, also for both ratios of amine to acid. The low angle X-ray diffraction patterns gave two reflections for most of the samples which enabled the structure to be identified as lamellar. The interlayer spacings were calculated and applied against the solvent weight ratio as set forth in FIGS. 3–6, exhibiting a straight line relationship for all of the sample compositions. Generally, the interlayer spacing increased with an increase in the amount of solvent included in the compositions.

The preceding Example is set forth to illustrate specific embodiments of the invention and is not intended to limit the scope of the presently claimed compositions. Additional embodiments and advantages within the scope of the claimed invention will be apparent to one of ordinary skill in the art.

What is claimed is:

1. A non-aqueous liquid lubricant composition exhibiting lamellar liquid crystalline properties, consisting essentially of (a) an organic acid component selected from the group consisting of alkyl phosphonic acids, aryl phosphonic acids, alkyl sulfonic acids and aryl sulfonic acids, or a salt thereof;

(b) an organic amine component selected from the group consisting of ethanolamine, diethanolamine, triethanolamine, ethyldiethanol amine, tallow amine, n-dodecyl-1,3-diaminopropane, n-oleyl-1,3-diaminopropane and n,n-dimethyl aminothioethers; and (c) a non-aqueous solvent which maintains liquid crystalline properties of a mixture of components (a) and (b), the weight ratios of components (a), (b) and (c) being such that the composition exhibits lamellar liquid crystalline properties, (a)/(b) is the range of about 1:1 to about 5:1, and component (c) comprises not greater than about 75 weight percent of components (a), (b) and (c) combined.

2. A non-aqueous liquid lubricant composition as defined by claim 1, wherein the acid component or salt thereof includes an alkyl group having from 6 to 20 carbon atoms.

3. A non-aqueous liquid lubricant composition as defined by claim 2, wherein the acid component comprises dodecylbenzene sulfonic acid.

4. A non-aqueous liquid lubricant composition as defined by claim 1, wherein the amine component comprises triethanolamine.

5. A non-aqueous liquid lubricant composition as defined by claim 1, wherein the non-aqueous solvent is selected from the group consisting of glycols, squalane, mineral oils, hydrocarbon esters and silicone fluids.

6. A non-aqueous liquid lubricant composition as defined by claim 1, wherein the weight ratio of components (a) and (b) is in the range of 1:1 to 3:1.

7. A non-aqueous liquid lubricant composition as defined by claim 1, wherein component (c) comprises not greater than 50 weight percent of components (a), (b) and (c).

8. A non-aqueous liquid lubricant composition as defined by claim 1, further including at least one additive selected from the group consisting of oxidation inhibitors, corrosion inhibitors and extreme pressure agents, which additive does not destroy the liquid crystalline properties of the composition.

9. A non-aqueous liquid lubricant composition exhibiting lamellar liquid crystalline properties, consisting essentially of (a) an organic acid component selected from the group consisting of alkyl sulfonic acids and alkyl phosphonic acids, or a salt thereof;

(b) triethanolamine; and (c) a non-aqueous solvent which maintains the liquid crystalline properties of components (a) and (b), and which is selected from the group consisting of glycols, squalane, mineral oils, hydrogen esters and silicone fluids, the ratios of components (a), (b) and (c) being such that the composition exhibits lamellar liquid crystalline properties, (a)/(b) is in the range of about 1:1 to about 3:1 and component (c) comprises not greater than about 25 weight percent of components (a), (b) and (c) combined.

10. A lubricating composition, comprising (a) a lubricating oil; and (b) a friction modifier formed of an on-aqueous lamellar liquid crystalline material consisting essentially of (i) an organic acid component selected from the group consisting of alkyl phosphonic acids, aryl phosphonic acids, alkyl sulfonic acids and aryl sulfonic acids, or a salt thereof;

(ii) an organic amine component selected from the group consisting of ethanolamine, diethanolamine, triethanolamine, ethyldiethanol amine, tallow amine, n-dodecyl-1,3-diaminopropane, n-oleyl-1,3-diaminopropane and n,n-dimethyl aminothioethers; and (iii) a non-aqueous solvent which maintains liquid crystalline properties of a mixture of components (a) and (b), the weight ratios of components (i), (ii) and (iii) being such that the composition exhibits lamellar liquid crystalline properties, (i)/(ii) is the range of about 1:1 to about 5:1, and component (iii) comprises not greater than about 75 weight percent of components (i), (ii) and (iii) combined.

11. A lubricating composition as defined by claim 10, wherein the lubricating oil comprises a synthetic oil.

12. A lubricating composition as defined by claim 10, wherein the lubricating oil comprises a mineral oil.

13. A lubricating composition as defined by claim 10, wherein the friction modifier is included in an amount of about 0.1 to about 5 weight percent.

* * * * *